US006686113B2

(12) United States Patent
Kobayashi et al.

(10) Patent No.: US 6,686,113 B2
(45) Date of Patent: Feb. 3, 2004

(54) CARRIER FOR ELECTROPHOTOGRAPHIC DEVELOPER AND DEVELOPER CONTAINING THE SAME

(75) Inventors: Hiromichi Kobayashi, Kashiwa (JP); Tsuyoshi Itagoshi, Kashiwa (JP); Takeshi Naito, Kashiwa (JP); Yuji Sato, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 0 days.

(21) Appl. No.: 10/173,784

(22) Filed: Jun. 19, 2002

(65) Prior Publication Data

US 2003/0091923 A1 May 15, 2003

(30) Foreign Application Priority Data

Sep. 18, 2001 (JP) ..... 2001-282835

(51) Int. Cl.[7] ..... G03G 9/113

(52) U.S. Cl. ..... 430/111.33; 430/111.32; 430/111.1; 430/111.35

(58) Field of Search ..... 430/111.35, 111.33, 430/111.32, 111.1

(56) References Cited

U.S. PATENT DOCUMENTS

| | | | | |
|---|---|---|---|---|
| 5,670,287 A | * | 9/1997 | Kawata et al. | 430/111.32 |
| 5,952,143 A | | 9/1999 | Ootaki et al. | |
| 6,106,987 A | * | 8/2000 | Hakata et al. | 430/111.35 |
| 6,534,232 B1 | * | 3/2003 | Matsuda et al. | 430/111.32 |
| 2003/0044712 A1 | * | 3/2003 | Matsui et al. | 430/111.32 |

FOREIGN PATENT DOCUMENTS

| | | |
|---|---|---|
| EP | 0 351 712 | 1/1990 |
| EP | 0 694 818 | 1/1996 |
| EP | 1 037 118 | 9/2000 |
| JP | A 63-243962 | 10/1988 |
| JP | A 7-287422 | 10/1995 |
| JP | A 7-301958 | 11/1995 |
| JP | A 8-62899 | 3/1996 |
| JP | A 8-76407 | 3/1996 |
| JP | A 11-295934 | 10/1999 |

* cited by examiner

*Primary Examiner*—Christopher Rodee
(74) *Attorney, Agent, or Firm*—Young & Thompson

(57) ABSTRACT

A resin-coated carrier to be mixed with a polymer toner obtained by suspension polymerization or emulsion polymerization to provide an electrophotographic developer, which exposes 2 to 20% of the surface area of the core thereof, the average exposed area ratio per exposed part of the core being 0.03% or less.

9 Claims, 1 Drawing Sheet

CARRIER FOR ELECTROPHOTOGRAPHIC DEVELOPER AND DEVELOPER CONTAINING THE SAME

FIELD OF THE INVENTION

The present invention relates to a carrier to be mixed with a polymer toner to provide a two-component developer for electrophotography and a developer containing the carrier.

BACKGROUND OF THE INVENTION

A two-component dry developer for electrophotography comprises a toner and a carrier. A carrier is mixed with a toner in a mixing zone of a developing machine to give a desired charge quantity to the toner and carries the charged toner to an electrostatic latent image formed on a photoreceptor to form a toner image. The developer is replenished with a supplementary amount of a fresh toner for repeated use.

Applications of the developer of this type have been diversified with the wide spread of electrophotographic equipment such as copiers, facsimiles, and printers. In particular, market demands for higher image quality and a longer developer life have been increasing.

To meet the demand for higher image quality, reduction of a toner particle size has been proposed. Since toner particle size reduction tends to be accompanied by reduction of chargeability, it is necessary for the carrier to have a reduced particle size to gain in specific surface area for imparting a sufficient charge quantity to the toner. However, a developer comprising a smaller size toner and a smaller size carrier has poorer flowability to have a slower rise of charge, which can cause such problems as toner scattering.

Intensified mixing has been suggested to improve the flowability, which increases the stress on the developer. An increased stress will induce a spent-toner phenomenon as it is called (adhesion of a toner to the surface of the carrier particles) and cause the resin coat to fall off the carrier core, thereby accelerating deterioration of the developer. As a result, the developer cannot maintain satisfactory developing performance for a long period of time. Additionally, reduction of toner's particle size results in reduction of production yield, leading to an increase of cost.

To overcome these problems, polymer toners have recently been under development. Produced by polymerization methods involving no grinding step, polymer toners with small particle sizes can be obtained in good yield and, having rounded shapes, exhibit satisfactory flowability even with small particle sizes. Besides, compared with ground toners, polymer toners have sharper particle size distributions and are therefore fit for high quality imaging. However, because polymer toners are produced by polymerization in an aqueous solvent in the presence of a large quantity of a dispersant having a polar group, their charging characteristics largely fluctuate with environmental variations as compared with ground toners.

A number of developers have hitherto been proposed aiming at settlement of the environment dependence issue.

JP-A-7-301958 proposes a carrier coated with a coating agent containing a specific charge control agent for improving environmental stability. However, where the coated carrier is mixed with a polymer toner, the resulting developer undergoes reduction of charge especially under a high temperature high humidity condition, failing to fulfill the demand for environmental stability. The publication also suggests that the coverage of the coating film is increased above a certain level to reduce carrier adhesion. Where combined with a polymer toner, however, it is difficult to achieve reduction of carrier adhesion consistent with improvement on environmental stability.

JP-A-8-62899 discloses use of a mixture of two carriers showing different changes with the environment. Mixing two kinds of carriers seemingly improves environmental stability but, in fact, results in a broadened charge distribution with environmental variations, which can cause fog, selective development with a toner, and the like. That is, the technique is insufficient for maintaining high image quality.

JP-A-7-287422 mentions that existence of 0.1 to 5% by number of metal atoms on the surface of silicone-coated carrier particles is effective in stabilizing charging to environmental variations and accelerating a rise of charge. JP-A-11-295934 teaches that existence of 7 to 20% by number of metal atoms, such as iron and alkali metals, on the surface of carrier particles prevents charges from being accumulated thereby to provide images stably even in a low temperature low humidity condition. However, developers comprising these carriers are liable to leak electricity in a high temperature high humidity condition, resulting in a failure to secure a desired charge quantity and causing toner scattering and fog.

JP-A-63-243962 proposes a developer comprising a specific polymer toner and a spherical carrier. According to the disclosure, the shear force imposed by carrier particles on toner particles can be reduced by using a spherical carrier and controlling the toner particle size and the carrier particle size within the respective specific ranges. The toner particles are thus prevented from being destroyed and exposing the low-softening component on their broken surface. As a result, toner's filming on the sleeve can be prevented. However, considering that the fluctuation in charge quantity with environmental variation is admittedly attributed to the interactions between moisture in the air and a developer, the balance between leakage and accumulation of charges could not be stabilized to environmental changes merely by using spherical carrier particles. That is, the proposed developer does not sufficiently meet the demand for environmental stability.

JP-A-8-76407 proposes controlling the concentration of a toner and the specific gravity and the average particle size of a toner and a carrier to improve environmental stability of a polymer toner. Seeing that the environment dependence is decided chiefly by the mutual action among a toner, a carrier, and the moisture content of the environment, the above proposal alone results in a failure to retain high image quality.

As reviewed above, a large amount of a dispersant having a polar group is used in the polymerization system comprising an aqueous solvent for the preparation of polymer toners. Although the produced polymer particles are worked up by washing, drying or other means, a water content or the dispersant inevitably remain in and/or on the particles. Probably because such residual substances interact with the moisture content in the air, polymer toners show remarkable fluctuations of electrical characteristics with variations of environmental conditions, such as temperature and humidity, compared with ground toners.

In a high temperature high humidity condition, for example, the toner charge will reduce to cause toner scattering and fog and, besides, charges are apt to leak to destroy an electrostatic latent image, or the resistance of the developer tends to reduce to cause carrier adhesion.

In a low temperature low humidity condition, on the other hand, the toner charge will increase to reduce the image density. In case of an extreme increase in charge quantity, the carrier is dragged with the polymer toner being transferred to a photoreceptor, resulting in carrier adhesion. The resistance of the developer also increases, resulting in a reduced effective bias, which can cause image density reduction and fog.

While the causes of charge variations with environmental variation have not necessarily been elucidated, destruction of the balance among (i) the charge transfer rate between a carrier and a toner, (ii) the degree of charge accumulation, and (iii) the degree of charge leakage by a moisture content is one of the causes.

Increasing carrier's resistance too much in an attempt to prevent charge leakage in a high temperature high humidity condition would result in reduction of developing ability (failure of obtaining a sufficient image density) and would accelerate charge accumulation in a low temperature low humidity condition. If the resistance of a carrier or a toner is decreased in an attempt to suppress excessive charge accumulation in a low temperature low humidity condition, fogging on a drum due to carrier adhesion or charge injection can result, and charge leakage in a high temperature high humidity condition would be accelerated.

SUMMARY OF THE INVENTION

An object of the present invention is to provide a carrier to be mixed with a polymer toner to make an electrophotographic developer which has reduced environment dependence of charge quantity to assure satisfactory imaging performance with no carrier adhesion under broad environmental conditions from a low temperature low humidity condition to a high temperature high humidity condition.

Another object of the present invention is to provide a developer containing the carrier.

The present inventors have extensively studied on charge stability of a developer comprising a polymer toner against environmental variations. As a result, they have found it important for obtaining environmental stability that the balance between charge accumulation and leakage should be stable to environmental variation. They have found that a resin-coated carrier having an optimum area of its core exposed provides a developer which achieves charge stabilization for an extended period of time while retaining high quality imaging characteristics free of image defects such as carrier adhesion.

The present invention provides a resin-coated carrier to be mixed with a polymer toner obtained by suspension polymerization or emulsion polymerization to provide an electrophotographic developer, which exposes 2 to 20% of the surface area of the core thereof, the average exposed area ratio per exposed part being 0.03% or less.

The present invention also provides an electrophotographic developer comprising the above-described carrier and a polymer toner obtained by suspension polymerization or emulsion polymerization.

The carrier and the developer according to the present invention hold a good balance between charge leakage in a high temperature high humidity condition and charge accumulation in a low temperature low humidity condition thereby to retain stable charging characteristics against environmental changes while exhibiting high quality imaging characteristics free from image defects, such as carrier adhesion, for a prolonged period of time.

DETAILED DESCRIPTION OF THE INVENTION

Figure 1:
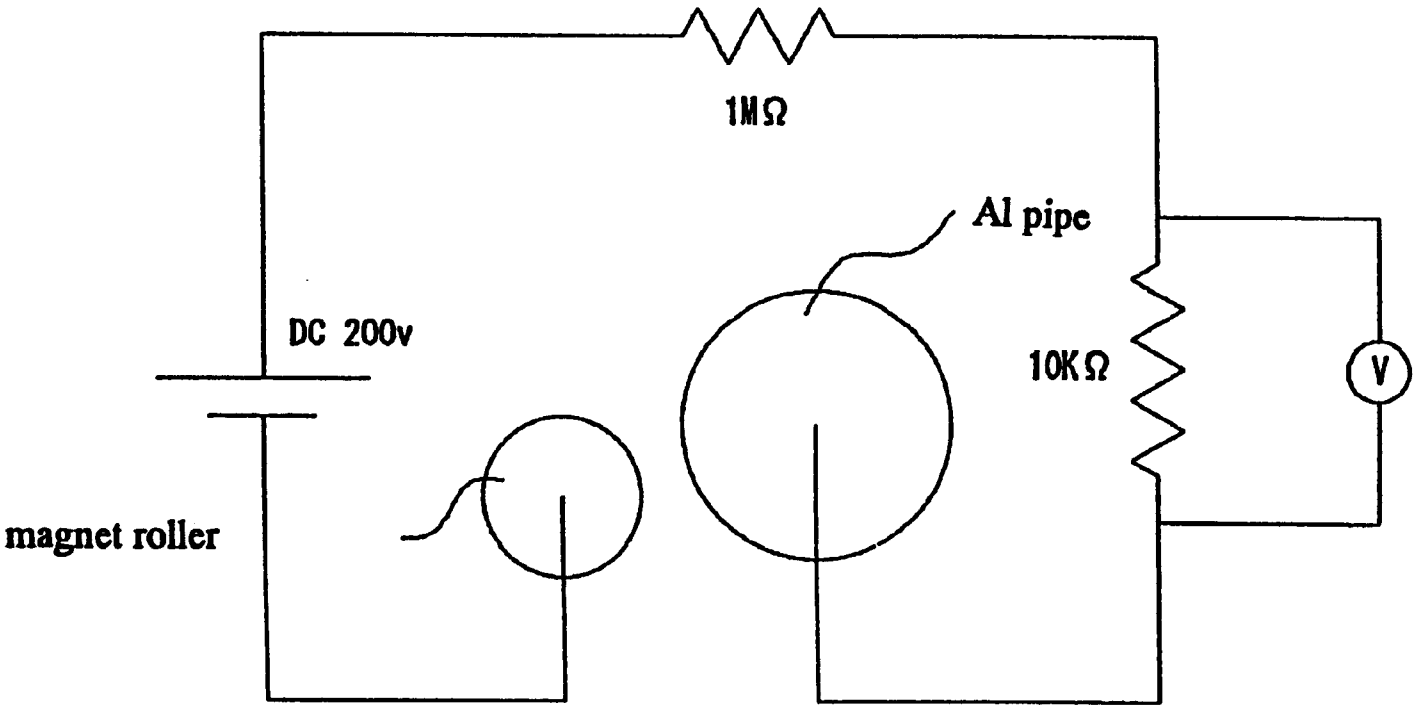
FIG. 1 is a schematic illustration of a current meter used to measure a current of a carrier.

The resin-coated carrier according to the present invention has its core exposed in an area ratio of 2 to 20% (hereinafter referred to as an exposed core area ratio). A preferred exposed core area ratio is 3 to 18%, particularly 3 to 15%. An exposed core area ratio less than 2% results in too high resistance to achieve a sufficient image density. An increased image density could be obtained by lowering the resistance by addition of a conductive material, but such will need a large amount of a conductive material, which tends to lead to charge leakage in a high temperature high humidity condition. An exposed core area ratio exceeding 20% results in much charge leakage to give adverse influences.

It is necessary that an average area ratio per exposed part be 0.03% or less. Where this ratio is more than 0.03% even through the total exposed core area ratio falls within the above-recited range, individual exposed parts of the core are so large that the carrier particles are susceptible to the influences from moisture, showing tendency to charge leakage in a high temperature high humidity condition.

It is preferred to incorporate a conductive material into the coating resin of the coated carrier. Since the exposed core area ratio is relatively small, there is a tendency that the absolute resistance becomes too high, resulting in reduction of developing ability. Addition of a conductive material is a countermeasure against this tendency. However, because the resistance possessed by a conductive material per se is lower than that of the coating resin or the core, too much addition of a conductive material leads to abrupt charge leaks. Accordingly, it is important that the amount of a conductive material to be added should fall within a range of 0.5 to 30%, preferably 0.5 to 15%, still preferably 0.5 to 6%, by weight based on the solids content of the coating resin. At amounts less than 0.5% by weight, the carrier tends to have too high resistance to provide a sufficient image density. At amounts more than 30% by weight, charge leakage occurs easily, which will cause fogging in a high temperature high humidity condition.

Useful conductive materials include conductive carbon and conductive oxides such as titanium oxide and tin oxide. Conductive carbon is preferred for carriers to be combined with black toners. Conductive oxides such as titanium oxide are preferred for carriers to be combined with color toners.

The coating resin preferably contains a silane coupling agent as a charge control agent. Where the exposed core area ratio is relatively low, the charging ability of the carrier tends to reduce, which can be compensated for by addition of a silane coupling agent to the coating resin. While coupling agents that can be used are not limited in kind, it is advisable to use aminosilane coupling agents for negatively chargeable toners and fluorine type silane coupling agents for positively chargeable toners. The coupling agent is preferably added in an amount of 2 to 60% by weight based on the solids content of the coating resin.

Various resins can be used to form a resin coat on the carrier core. Useful resins include fluorine resins, acrylic resins, epoxy resins, polyester resins, fluoroacrylic resins, acrylic styrene resins, silicone resins, acrylic resin-, polyester resin-, epoxy resin-, alkyd resin- or urethane resin-modified silicone resins, and crosslinkable fluorine-modified silicone resins.

In selecting the coating resin, it should be taken into consideration that a resin coat is liable to fall off or wear or fuse to cause a spent-toner phenomenon under stress imposed due to collisions among particles in a mixing zone or against a doctor blade. In order to avoid these disadvantages and to maintain stabilized developer characteristics for a long time, resins having a unit represented by formula (I) and/or a unit represented by formula (II) are preferably used for their wear resistance, fall-off resistance, and fusion resistance. These resins are also effective for water repellency.

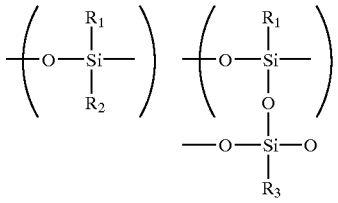

where $R_1$, $R_2$, and $R_3$ each represent a hydrogen atom, a halogen atom, a hydroxyl group, a methoxy group, an alkyl group having 1 to 4 carbon atoms or a phenyl group.

Resins having the unit of formula (I) and/or the unit of formula (II) include the above-recited straight silicone resins, organic group-modified silicone resins, and fluorine-modified silicone resins. The fluorine-modified silicone resins include crosslinking-curable fluorine-modified silicone resins obtained by hydrolyzing an organosilicone compound containing the unit (I) and/or (II) and a perfluoroalkyl group. The perfluoroalkyl-containing organosilicone compound includes $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$,and $(CF_3)_2CF(CF_2)_8CH_2CH_2Si(OCH_{3)3}$. Particulary preferred of the above-described resins are silicone resins and fluorine-modified silicone resins.

Coating the carrier core with the resin is carried out in a usual manner, for example, spread coating with a brush, powder coating, fluidized bed spray drying, a rotary dryer method, or dip coating by use of a universal agitator. A fluidized bed coating system is preferred for securing coverage as required.

A preferred resin coating weight is 0.3 to 10%, particularly 0.5 to 7%, especially 1.2 to 4%, by weight based on the carrier core. It is difficult to form a uniform coating film with a coating weight less than 0.3% by weight. A coating weight exceeding 10% by weight may induce agglomeration of coated carrier particles, which causes variation of developer characteristics.

After coating, the coating film is baked, if desired, either by external heating or internal heating by means of, for example, a fixed bed or fluidized bed electric oven, a rotary kiln type electric oven, a burner oven, or a microwave oven. The baking temperature depends on the resin and should be at least the melting point or glass transition point of the resin used. In using a heat-curing or condensation-curing resin, the baking temperature should be raised up to a point at which curing proceeds sufficiently.

The exposed core area ratio can be controlled by not only the coating weight but also the method of coating or the conditions of coating or baking. The exposed core area ratio can also be adjusted by post-baking mechanical treatment in a vibromill or a Naughter mixer.

The core particles thus coated with the resin and baked are cooled, disintegrated, and regulated in size to obtain a resin-coated carrier.

The carrier preferably has an average particle size of 20 to 100 $\mu$m, particularly 25 to 80 $\mu$m. Smaller sizes than 20 $\mu$m are effective for high quality imaging but have a reduced magnetization per particle, which can cause carrier adhesion. Carrier particles greater than 100 $\mu$m not only have difficulty in imparting sufficient charges to a toner probably because of a decreased specific surface area but also cause image quality deterioration.

Core materials which can be used in the carrier include, but are not limited to, iron powder, ferrites, and magnetite. Ferrites are preferred. Iron powder having a high saturation magnetization, while effective for preventing carrier adhesion, forms high and hard chains which may scrape off the toner once transported to a photoreceptor to cause brush marks. Iron powder having low resistance, the charges tend to leak to destroy the electrostatic latent image on a photoreceptor, which also causes brush marks. Ferrites are generally represented by formula: $(MO)_x(Fe_2O_3)_y$, wherein M represents at least one of Cu, Zn, Fe, Mg, Mn, Ca, Li, Ti, Ni, Sn, Sr, Al, Ba, Co, Mo, etc.; and x and y represent a molar ratio satisfying x+y=100.

Of the ferrites represented by the above formula, preferred are those in which M comprises at least one of Li, Mg, Ca, Mn, Sr, and Sn and may contain not more than 1% by weight of the other elements. Existence of Cu, Zn or Ni tends to lower the resistance to cause charge leakage, tends to make coating difficult, and tends to deteriorate environmental stability. Moreover, existence of Cu, Zn and Ni increases the stress imposed on the carrier assumably because of their heaviness, which can adversely affect the service life of the developer.

Ferrite core particles are prepared by, for example, the following method. Weighed oxide raw materials are mixed and ground in a wet ball mill for 10 hours, dried, and fired at 950° C. for 4 hours. The product is ground in a wet ball mill for 24 hours to a particle size of 5 $\mu$m or smaller. The resulting slurry is granulated. After drying, the granules are fired at 1100 to 1300° C. for 6 hours in an atmosphere with a controlled oxygen concentration for the purpose of adjusting magnetic characteristics and resistance. The particles are then ground and classified to have a desired particle size distribution.

The exposed area ratio of the core can also be controlled by selecting the kinds or the mixing ratio of the oxide raw materials, the firing temperature and time, and the oxygen concentration of the firing atmosphere.

The electrophotographic developer according to the present invention is obtained by mixing the carrier thus prepared with a polymer toner. The toner concentration is usually 1 to 10%, preferably 2 to 7%, by weight.

The polymer toner which can be used in the present invention is prepared by known methods, such as a suspension polymerization method and an emulsion polymerization method. For example, an aqueous dispersion of a colorant containing a surface active agent and an emulsion prepared by dispersing a monomer(s), a surface active agent, and a polymerization initiator in an aqueous medium are mixed by stirring to carry out polymerization. A salting-out agent is added to the reaction mixture to cause salting out. The precipitated particles are collected by filtration, washed, and dried to obtain polymer toner particles, to which necessary external additives are added.

A fixability improving agent and a charge control agent can be incorporated into the toner to improve the toner characteristics. A chain transfer agent can be used in the polymerization system to assist emulsification and to control the molecular weight of the resulting polymer.

Monomers providing the polymer toners include, but are not limited to, styrene and its derivatives; ethylenically unsaturated monoolefins, such as ethylene and propylene; vinyl halides, such as vinyl chloride; vinyl esters, such as vinyl acetate; and a-methylene aliphatic monocarboxylic esters, such as methyl acrylate, ethyl acrylate, methyl methacrylate, ethyl methacrylate, 2-ethylhexyl methacrylate, dimethylamino acrylate, and diethylamino methacrylate.

Any well-known dyes and/or pigments are useful as a colorant. Examples of suitable colorants are carbon black, Phthalocyanine Blue, Permanent Red, Chrome Yellow, and Phthalocyanine Green. The colorant may be surface modified by a silane coupling agent, a titanium coupling agent, etc.

Surface active agents which can be used in the polymer toner include anionic ones, cationic ones, amphoteric ones, and nonionic ones.

Suitable anionic surface active agents include fatty acid salts, e.g., sodium oleate and a potash soap made of potassium and castor oil; alkylsulfuric ester salts, e.g., sodium laurylsulfate and ammonium laurylsulfate; alkylbenzenesulfonates, e.g., sodium dodecylbenzenesulfonate; alkylnaphthalenesulfonates, alkylphosphoric ester salts, naphthalanesulfonic acid-formalin condensates, and polyoxyethylene alkylsulfuric ester salts.

Suitable nonionic surface active agents include polyoxyethylene alkyl ethers, polyoxyethylene fatty acid esters, sorbitan fatty acid esters, polyoxyethylene alkylamines, glycerol, fatty acid esters, and oxyethylene-oxypropylene block copolymers.

Suitable cationic surface active agents include alkylamine salts, such as laurylamine acetate, and quaternary ammonium salts, such as lauryltrimethylammonium chloride and stearyltrimethylammonium chloride.

Suitable amphoteric surface active agents include aminocarboxylic acid salts and alkylamino acids.

The surface active agents are added preferably in an amount of about 0.01 to 10% by weight based on the monomers. Emulsion polymerization is difficult to carry out stably with too small an amount of the surface active agents. Too large an amount of the surface active agent can give adverse influences on the toner's environmental stability.

The polymerization initiator which can be used includes water-soluble ones, such as persulfates (e.g., potassium persulfate and ammonium persulfate) and water-soluble peroxide compounds; and oil-soluble ones, such as azo compounds (e.g., azobisisobutyronitrile), and oil-soluble peroxide compounds.

The chain transfer agent which can be used includes mercaptan compounds, such as octylmercaptan, dodecylmercaptan, and t-dodecylmercaptan.

The fixability improvement agent which can be used includes natural waxes, such as carnauba wax, and olefin waxes, such as polypropylene and polyethylene.

The charge control agent which can be used in the toner includes nigrosine dyes, quaternary ammonium salts, organometal complexes, and metallized monoazo dyes.

External additives useful for improving flowability and the like include silica, hydrophobilized silica, titanium oxide, hydrophobilized titanium oxide, barium titanate, fluoropolymer particles, acrylic resin particles, and mixtures thereof.

The salting-out agent which can be used includes metal salts, such as magnesium sulfate, aluminum sulfate, barium chloride, magnesium chloride, calcium chloride, and sodium chloride.

The characteristics of the carrier and the developer are measured as follows.

(1) Exposed Core Area Ratio and Average Exposed Area Ratio Per Exposed Part

A reflection electron microscopic (REM) image was taken of a carrier under an electron microscope JSM-6100, supplied by JEOL Ltd., at an applied voltage of 5 kV. The REM image is read with a scanner and processed by image analysis software Image-Pro Plus from Media Cybernetics. The image is first processed into an image solely of particles, which is then binarized into white parts (exposed parts) and black portions (coated parts). The area and the number of the white parts and the black parts are measured to calculate an exposed core area (total) ratio (%) and an average exposed area per exposed part according to the following equations:

Exposed core area ratio (%)=[total area of white parts/(total area of white parts+total area of black parts)]×100

Average area ratio per exposed part (%/part)=exposed core area ratio/number of white parts (2) Toner Charge A mixture of 5 g of a toner and 95 g of a carrier was allowed to stand in a high temperature high humidity condition (35° C., 80% RH; hereinafter referred to as an HH condition) or a low temperature low humidity condition (10° C., 20% RH; hereinafter referred to as an LL condition) each for 12 hours and then put into a 100 cc plastic bottle in the respective condition. The mixture is agitated in a ball mill at 100 rpm for 30 minutes under the respective condition. A 0.2 g portion of the developer is put into a Faraday cage having 500 mesh stainless steel screens, and the toner is blown off the carrier by nitrogen gas having a pressure of 1 kgf/cm$^2$ for 60 seconds. A toner charge-to-mass ratio ($\mu$C/g) is calculated from the charge remaining in the cage and the mass of the toner.

(3) Average Particle Size of Carrier

Measurement was made with a particle size analyzer MICROTRAC 9320-X100, available from Nikkiso Co., Ltd.

(4) Electric Current of Carrier

Before measurement, a carrier weighing 800 g is allowed to stand at 20 to 26° C. and 50 to 60% RH for at least 15 minutes. Measurement is made using a current meter shown in FIG. 1, which has a magnet roller and an aluminum pipe as probe electrodes set at 4.5 mm apart. A voltage of 200 V is applied.

The present invention will now be illustrated in greater detail with reference to Examples and Comparative Examples, but it should be understood that the invention is not construed as being limited thereto.

EXAMPLE 1

Preparation of Carrier

Raw materials were compounded to give a composition having an $Li_2O$ content of 13.3 mol %, an $Fe_2O_3$ content of 76.2 mol %, an MgO content of 7.7 mol %, and a CaO content of 2.8 mol % and wet ground with water in a ball mill for 10 hours. After drying, the blend was kept at 950° C. for 4 hours and again wet ground in a ball mill for 24 hours. The resulting slurry was granulated and dried. The granules were kept at 1190° C. for 6 hours in the air, followed by disintegration and classification to obtain lithium ferrite particles as a core. The resulting core particles had an average particle size of 60 $\mu$m and a saturation magnetization of 60 emu/g in an applied magnetic field of 3000 Oe.

A silicone resin SR-2411, available from Dow Corning Toray Silicone Co., Ltd., weighing 200 g (on a dry basis) and 100 g of an aminosilane coupling agent KBE903, available from Shin-Etsu Chemical Co., Ltd. were dissolved in 1000 ml of toluene. Conductive carbon KETJENBLACK EC, available from Ketjen Black International, was dispersed in the solution in an amount of 2 wt % based on the solid content of the resin in a pearl mill.

The silicone resin solution having conductive carbon dispersed therein was sprayed onto 10 kg of the lithium ferrite particles by use of a fluidized bed coating apparatus. The rate of spraying was adjusted so that spraying completed in 80 minutes. The coating layer was baked at 260° C. for 1 hour to obtain a carrier, designated carrier 1. Carrier 1 had a current of 0.45 $\mu$A, a charge quantity of 18.4 $\mu$C/g in an HH condition and 22.1 $\mu$C/g in an LL condition, giving only a small environment dependent variation, 3.7 $\mu$C/g. The exposed core area ratio was 4.5%, and the average area ratio per exposed part was 0.007%.

Preparation of Toner

In 150 g of ion-exchanged water were dispersed 15 g of carbon black (REGAL 330R, available from Cabot Corp.) and 7 g of sodium dodecylsulfate in a dispersive pressure homogenizer to prepare a colorant dispersion.

To the colorant dispersion were added 2000 g of ion-exchanged water, 280 g of styrene, 50 g of n-butyl acrylate, 20 g of methacrylic acid, and 3 g of t-dodecylmercaptan, and the inner temperature was raised to 80° C. while stirring. A solution of 8 g of potassium persulfate in 600 g of ion-exchanged water was added thereto to carry out polymerization for 7 hours, followed by cooling to obtain a dispersion of colorant-containing polymer particles.

A potassium chloride aqueous solution was added to the polymer dispersion while stirring to cause association at 90° C. for 6 hours, followed by cooling to room temperature. The reaction mixture was filtered, and the solid collected was washed with distilled water, dried, and mixed with 1 wt % hydrophobic silica powder as a fluidizing agent to yield a polymer toner.

Carrier 1 and the polymer toner were mixed to prepare a developer having a toner concentration of 5 wt %. The developer was tested on a commercially available copier AR-S400, supplied from Sharp Corp. The results obtained are shown in Table 2 below. The density of the image formed in an LL condition was 1.30 measured with a Macbeth densitometer (RD914), and the fog of the image formed in an HH condition was 0.68 measured with a color difference meter (Z300A, from Nippon Denshoku Industries Co., Ltd.). These results indicate that the developer provided toner images with sufficient image density and no fog over a broad environmental conditions of from low to high temperature and from low to high humidity.

The environment dependence of toner charge (difference Δ between toner charge in an LL condition and that in an HH condition) and the results of the practical copying test were rated according to the following criteria.

(a) Environment dependence of toner charge (Δ;μC/g)

A . . . 5.0 or less

B . . . more than 5.0 up to 10.0

C . . . more than 10.0 up to 15.0

D . . . more than 15.0

(b) Image density (measured with Macbeth densitometer RD914)

A . . . 1.25 or more

B . . . 1.15 or more and less than 1.25

C . . . 1.00 or more and less than 1.15

D . . . less than 1.00

(c) Fog (measured with color difference meter Z300A)

A . . . less than 0.70

B . . . 0.70 or more and less than 1.00

C . . . 1.00 or more and less than 1.50

D . . . 1.50 or more

In the following Examples and Comparative Examples, only the conditions for preparing carriers are described. The exposed core area ratio and the average area ratio per exposed part of the resulting carrier particles are shown in Table 1. The results of measurement and evaluation are shown in Table 2.

EXAMPLE 2

Raw materials were compounded to give a composition having an MnO content of 39.7 mol %, an MgO content of 9.9 mol %, an $Fe_2O_3$ content of 49.6 mol %, and an SrO content of 0.8 mol % and wet ground with water in a ball mill for 10 hours. After drying, the blend was kept at 950° C. for 4 hours and again wet ground in a ball mill for 24 hours. The resulting slurry was granulated and dried. The granules were kept at 1285° C. for 6 hours in a atmosphere having an oxygen concentration of 3%, disintegrated, and regulated in size to obtain manganese ferrite particles as a core. The manganese ferrite particles had an average particle size of 60 μm and a saturation magnetization of 65 emu/g in an applied magnetic field of 3000 Oe.

A silicone resin (SR-2411, from Dow Corning Toray Silicone Co., Ltd.) weighing 150 g (on a dry basis) and 75 g of an aminosilane coupling agent (KBE903, from Shin-Etsu Chemical Co., Ltd.) were dissolved in 1000 ml of toluene. Conductive carbon (KETJENBLACK EC, from Ketjen Black International) was dispersed in the solution in an amount of 2 wt % based on the solid content of the resin in a pearl mill.

The silicone resin solution having conductive carbon dispersed therein was sprayed onto 10 kg of the ferrite particles by use of a fluidized bed coating apparatus. The rate of spraying was adjusted so that spraying completed in 60 minutes. The coating layer was baked at 220° C. for 1 hour to obtain carrier 2. A practical copying test was carried out in the same manner as in Example 1, except for using carrier 2.

EXAMPLE 3

A silicone resin (SR-2411, from Dow Corning Toray Silicone Co., Ltd.) weighing 120 g (on a dry basis) and 36 g of an aminosilane coupling agent (KBE903, from Shin-Etsu Chemical Co., Ltd.) were dissolved in 1000 ml of toluene. Conductive carbon (KETJENBLACK EC, from Ketjen Black International) was dispersed in the solution in an amount of 1.5 wt % based on the solid content of the resin in a pearl mill.

The silicone resin solution having conductive carbon dispersed therein was sprayed onto 10 kg of the same ferrite particles as used in Example 2 by use of a fluidized bed coating apparatus. The rate of spraying was adjusted so that spraying completed in 50 minutes. The coating layer was baked at 220° C. for 1 hour to obtain carrier 3. A practical copying test was carried out in the same manner as in Example 1, except for using carrier 3.

Comparative Example 1

A resin solution prepared by dissolving 100 g (on a solid basis) of a silicone resin (SR-2411, from Dow Corning Toray Silicone Co., Ltd.) in 500 ml of toluene was coated on 10 kg of the same ferrite particles as used in Example 1 in a Henschel mixer. The coating layer was baked at 220° C. for 1 hour to obtain carrier 4. A practical copying test was carried out in the same manner as in Example 1, except for using carrier 4.

Comparative Example 2

A resin solution prepared by dissolving 30 g (on a solid basis) of a silicone resin (SR-2411, from Dow Corning Toray Silicone Co., Ltd.) in 500 ml of toluene was sprayed onto 10 kg of the same ferrite particles as used in Example 1 by use of a fluidized bed coating apparatus. The rate of spraying was adjusted so that spraying completed in 30 minutes. The coating layer was baked at 220° C. for 1 hour to obtain carrier 5. A practical copying test was carried out in the same manner as in Example 1, except for using carrier 5.

Comparative Example 3

Raw materials were compounded to give a composition having a CuO content of 14.0 mol %, an $Fe_2O_3$ content of 70.0 mol %, and a ZnO content of 16.0 mol % and wet ground with water in a ball mill for 10 hours. After drying, the blend was kept at 950° C. for 4 hours and again wet ground in a ball mill for 24 hours. The resulting slurry was granulated and dried. The granules were kept at 1040° C. for 6 hours in the air, disintegrated, and regulated in size to obtain copper-zinc ferrite particles as a core. The copper-zinc ferrite particles had an average particle size of 60 μm and a saturation magnetization of 65 emu/g in an applied magnetic field of 3000 Oe.

In 600 ml of toluene was dissolved 80 g (on a solid basis) of an acrylic resin (BR-80, available from Mitubishi Rayon Co., Ltd.), and 9 wt %, based on the solid content of the resin, of conductive carbon (KETJENBLACK EC, from Ketjen Black International) was dispersed in the resin solution in a pearl mill.

The copper-zinc ferrite particles weighing 10 kg were coated with the resin solution having the conductive carbon dispersed by mixing in a Henschel mixer. The coating layer was baked at 145° C. for 1 hour to obtain carrier 6. A practical copying test was carried out in the same manner as in Example 1, except for using carrier 6.

TABLE 1

| | Conditions of Carrier Preparation | | | | | | | | | | |
|---|---|---|---|---|---|---|---|---|---|---|---|
| | Carrier | Core | Average Particle Size (μm) | Coating Resin | Coating Weight (wt %) | Conductive Carbon (wt %) | Coupling Agent (wt %) | Curing Temp. (° C.) | Exposed Core Area Ratio (%) | Number of Exposed Parts | Average Area Ratio per Exposed Part (%) |
| Ex. 1 | 1 | Li—Mg—Ca—Fe | 60 | silicone resin | 2.0 | 2.0 | 50 | 260 | 4.5 | 626 | 0.007 |
| Ex. 2 | 2 | Mn—Mg—Sr—Fe | 60 | " | 1.5 | 2.0 | 50 | 220 | 13.7 | 1213 | 0.011 |
| Ex. 3 | 3 | Mn—Mg—Sr—Fe | 60 | " | 1.2 | 1.5 | 30 | 220 | 16.9 | 1257 | 0.013 |
| Comp. Ex. 1 | 4 | Li—Mg—Ca—Fe | 60 | " | 1.0 | 0.0 | 0 | 220 | 19.2 | 511 | 0.038 |
| Comp. Ex. 2 | 5 | Li—Mg—Ca—Fe | 60 | " | 0.3 | 0.0 | 0 | 220 | 45.3 | 1895 | 0.024 |
| Comp. Ex. 3 | 6 | Cu—Zn—Fe | 60 | acrylic resin | 0.8 | 9.0 | 0 | 145 | 39.6 | 925 | 0.043 |

TABLE 2

| | | | | | | | | Results of Evaluation | | | |
|---|---|---|---|---|---|---|---|---|---|---|---|
| | | Current | Toner Charge (μC/g) | | | Image Density | Fog | Environment | Image | | Overall |
| | Carrier | (μA) | HH | LL | Δ | (LL) | (HH) | Dependence | Density | Fog | Judgement |
| Ex. 1 | 1 | 0.45 | 18.4 | 22.1 | 3.7 | 1.30 | 0.68 | A | A | A | A |
| Ex. 2 | 2 | 1.70 | 20.3 | 26.2 | 5.9 | 1.16 | 0.62 | B | B | A | A |
| Ex. 3 | 3 | 0.62 | 16.5 | 25.2 | 8.7 | 1.19 | 0.76 | B | B | B | B |
| Comp. Ex. 1 | 4 | 0.12 | 12.5 | 27.3 | 14.8 | 1.13 | 1.00 | C | C | C | C |
| Comp. Ex. 2 | 5 | 1.20 | 8.5 | 29.5 | 21.0 | 1.08 | 1.47 | D | C | C | C |
| Comp. Ex. 3 | 6 | 165.00 | 2.5 | 45.1 | 42.6 | 0.84 | 1.85 | D | D | D | D |

What is claimed is:

1. A resin-coated carrier to be mixed with a polymer toner obtained by suspension polymerization or emulsion polymerization to provide an electrophotographic developer, which exposes 2 to 20% of the surface area of the core thereof, the average exposed area ratio per exposed part of the core being 0.03% or less.

2. The resin-coated carrier according to claim 1, wherein said resin contains 0.5 to 30% by weight of a conductive material based on the solids content.

3. The resin-coated carrier according to claim 2, wherein said resin contains a silane coupling agent.

4. The resin-coated carrier according to claim 2, wherein said resin comprises at least one of a unit represented by formula (I) and a unit represented by formula (II):

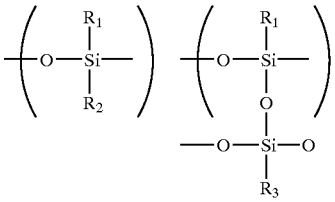

where $R_1$, $R_2$, and $R_3$ each represent a hydrogen atom, a halogen atom, a hydroxyl group, a methoxy group, an alkyl group having 1 to 4 carbon atoms or a phenyl group.

5. The resin-coated carrier according to claim 1, wherein said resin contains a silane coupling agent.

6. The resin-coated carrier according to claim 5, wherein said resin comprises at least one of a unit represented by formula (I) and a unit represented by formula (II):

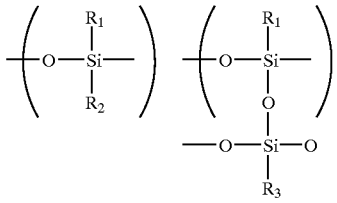

where $R_1$, $R_2$, and $R_3$ each represent a hydrogen atom, a halogen atom, a hydroxyl group, a methoxy group, an alkyl group having 1 to 4 carbon atoms or a phenyl group.

7. The resin-coated carrier according to claim 1 wherein said resin comprises at least one of a unit represented by formula (I) and a unit represented by formula (II):

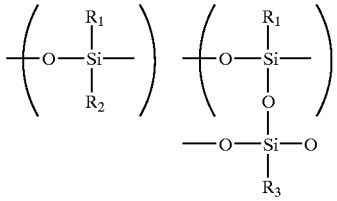

where $R_1$, $R_2$, and $R_3$ each represent a hydrogen atom, a halogen atom, a hydroxyl group, a methoxy group, an alkyl group having 1 to 4 carbon atoms or a phenyl group.

8. The resin-coated carrier according to claim 1, wherein said core is a ferrite mainly comprising oxygen, iron, and one or more of Li, Mg, Ca, Mn, Sr, and Sn and containing not more than 1% by weight of the other elements.

9. An electrophotographic developer comprising a carrier according to claim 1 and a polymer toner obtained by suspension polymerization or emulsion polymerization.

* * * * *